US011746762B2

(12) United States Patent
Nafz et al.

(10) Patent No.: US 11,746,762 B2
(45) Date of Patent: Sep. 5, 2023

(54) AXIAL PISTON MACHINE WITH HIGH DRIVE ROTATIONAL SPEED

(71) Applicant: Robert Bosch GmbH, Stuttgart (DE)

(72) Inventors: Timo Nafz, Horb (DE); Christoph Walz, Schopfloch (DE); Daniel Gieringer, St. Johann (DE); David Breuer, Tuebingen (DE); Joachim Binder, Albstadt (DE); Kai Bauckhage, Leonberg (DE); Matthias Blankenberg-Teich, Hanau (DE); Stefan Haug, Neu-Ulm (DE); Stephan Breckheimer, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/647,483

(22) Filed: Jan. 10, 2022

(65) Prior Publication Data

US 2022/0220948 A1 Jul. 14, 2022

(30) Foreign Application Priority Data

Jan. 12, 2021 (DE) ..... 10 2021 200 205.6

(51) Int. Cl.

| | |
|---|---|
| ***F04B 1/2064*** | (2020.01) |
| ***F04B 1/2078*** | (2020.01) |
| ***F04B 1/2071*** | (2020.01) |
| ***F03C 1/06*** | (2006.01) |

(52) U.S. Cl.

CPC ..... *F04B 1/2064* (2013.01); *F03C 1/0665* (2013.01); *F04B 1/2071* (2013.01); *F04B 1/2078* (2013.01)

(58) Field of Classification Search

CPC ..... F04B 1/20; F04B 1/2007; F04B 1/2021; F04B 1/2028; F04B 1/2035; F04B 1/2042; F04B 1/2064; F04B 1/2071; F04B 1/2085; F03C 1/0665; F03C 1/0636; F01B 3/0032; F01B 3/0052

See application file for complete search history.

(56) References Cited

U.S. PATENT DOCUMENTS

| | | | | |
|---|---|---|---|---|
| 5,011,377 | A * | 4/1991 | Sagawa | F04B 1/2064 91/499 |
| 5,700,094 | A * | 12/1997 | Dam | F16C 19/50 384/492 |
| 2008/0295680 | A1* | 12/2008 | Kunze | F04B 1/2042 91/392 |
| 2019/0309738 | A1* | 10/2019 | Hoppe | F04B 53/166 |

FOREIGN PATENT DOCUMENTS

| | | | |
|---|---|---|---|
| DE | 10 2015 208 925 | A1 | 11/2016 |
| GB | 1299123 | A * | 6/1972 |

* cited by examiner

*Primary Examiner* — Kenneth J Hansen

(74) *Attorney, Agent, or Firm* — Maginot, Moore & Beck LLP

(57) ABSTRACT

A swashplate-type axial piston machine includes a housing and at least one working channel extending through a distributor plate. The at least one working channel opens out at an outside on the housing at an associated working port. The at least one working channel includes a first section and a second section. The first section extends over the entire distributor plate. The second section is arranged entirely in the housing. The second section directly adjoins the first section. A first rotary bearing has an outer circumferential surface that defines a circular cylindrical reference cylinder about the axis of rotation.

13 Claims, 2 Drawing Sheets

AXIAL PISTON MACHINE WITH HIGH DRIVE ROTATIONAL SPEED

This application claims priority under 35 U.S.C. § 119 to patent application no. DE 10 2021 200 205.6, filed on Jan. 12, 2021 in Germany, the disclosure of which is incorporated herein by reference in its entirety.

The disclosure relates to an axial piston machine.

BACKGROUND

DE 10 2015 208 925 A1 has disclosed a swashplate-type axial piston machine. The axial piston machine is optimized for a high drive rotational speed by virtue of the mouth openings of the cylinders being arranged very close to the axis of rotation. It is consequently the case that low centrifugal forces act there even when the cylinder drum is rotating at very high speed. The suction limit is hereby shifted toward higher rotational speeds, wherein the risk of cavitation at the suction side is reduced. The suction limit is the rotational speed at which the axial piston machine still just aspirates as intended. If the rotational speed is increased further, so-called suction separation arises, that is to say the axial piston machine no longer aspirates at all, or the aspirated volume flow is considerably lower than the product of rotational speed and swept volume.

SUMMARY

An advantage of the disclosure consists in that the respective axial piston machine can be operated at an even higher rotational speed without cavitation occurring at the suction side. Here, the axial piston machine is of exceptionally simple construction and is consequently very inexpensive. The advantage of the ability to operate at higher rotational speeds comes at the cost of substantially only a slight increase in the structural space requirement.

It is proposed that the first rotary bearing is arranged with a spacing to the distributor plate in the direction of the axis of rotation, wherein the distributor plate is held on the support surface transversely with respect to the axis of rotation, wherein the first and the second section of the at least one working channel run parallel to the axis of rotation, wherein the first and second section are arranged entirely within, or are intersected by, the reference cylinder. Which of the two latter alternatives is used is dependent significantly on the selected construction of the first rotary bearing. The sliding surface is preferably of spherical design. It is preferably convexly curved with respect to the distributor plate. The first and/or the second rotary bearing are preferably designed as tapered-roller bearings.

Provision may be made for the first section of the at least one working channel to extend through the distributor plate with a constant cross-sectional shape, wherein the cross-sectional shape has at least one section that is configured as a slot which is curved about the axis of rotation. It is preferable for the cross-sectional shapes of the first sections of both working channels to each be defined by a single curved slot. Each slot preferably has a constant width over its entire length in the circumferential direction. The ends of the slot that are situated opposite one another with respect to the circumferential direction preferably comprise a straight section adjoined by two rounded corners. The prior art has disclosed cross-sectional shapes of the first section that are made up of multiple separate apertures. Such an embodiment is preferably specifically not used, so as to keep the cavitation tendency low.

Provision may be made for the second section to be directly adjoined by a third section of the at least one working channel, wherein the third section is arranged in the housing, wherein the cross-sectional central point of the third section runs along a curve with an unchanging curvature direction, wherein the corresponding curvature is selected such that the respective working channel runs, over its entire length, with a spacing to the first rotary bearing, wherein the working channel has the smallest spacing to the first rotary bearing in the third section. With the third section, the working channel is led past the first rotary bearing, wherein the cavitation tendency at the suction port is substantially not impaired. The cross-sectional central point is preferably to be understood to mean a center of area of the cross-sectional area of the working channel.

Provision may be made for a curvature direction of an inner delimiting surface of the third section to reverse along its course from the respective working port toward the distributor plate. This gives rise to a particularly low cavitation tendency at the suction port. For further details, reference is made to the corresponding statements relating to FIG. 1.

Provision may be made for exactly two working channels to be provided, the working ports of which point away from one another. The two working channels that result from this can be of particularly streamlined design, wherein they have identical flow characteristics. It is likewise conceivable for two working ports to be provided which point away from the cylinder drum in the direction of the axis of rotation. The latter embodiment is selected if the structural space in the superordinate machine necessitates this. The former embodiment however makes higher rotational speeds possible.

Provision may be made for the two working ports to each have a center of area, wherein the two centers of area define a straight reference line, wherein the straight reference line intersects the first rotary bearing. This arrangement of the working ports results in particularly streamlined working channels, wherein, in particular, the cavitation tendency at the suction port is low.

Provision may be made for the two working channels to be of mirror-symmetrical form with respect to one another, wherein the corresponding plane of symmetry encompasses the axis of rotation. The axial piston machine can thus be used in 4-quadrant operation, wherein similar delivery characteristics are realized in each of the four correspondingly possible operating states.

Provision may be made for the cylinder drum to have multiple cylinders which are of identical form to one another and which are arranged in uniformly distributed fashion about the axis of rotation, wherein each cylinder has a circular cylindrical section with a first cross-sectional area, wherein each cylinder has, in the region of the sliding surface, a mouth opening with a second cross-sectional area, wherein the second cross-sectional area is smaller than the first cross-sectional area, wherein the hydrostatic force that results from this during operation forces the cylinder drum against the sliding surface, wherein the cylinder drum is otherwise forced against the sliding surface exclusively by a single spring, wherein the spring lies against the end side of the cylinder drum. Accordingly, no spring is arranged radially between the cylinder drum and the drive shaft. The mouth openings and the first and the second sections can consequently be relocated inward to a very great extent. This results in a relatively large difference between the first and second cross-sectional area, which results in an intense hydrostatic contact pressure of the cylinder drum against the distributor plate. The second cross-sectional area is preferably between 40% and 70% of the first cross-sectional area. The claimed spring, which can be configured to be only relatively weak, is therefore sufficient for pressing the cylinder drum against the distributor plate. The spring is preferably supported on a separate pressure-exerting part with a spherical surface, wherein the spherical surface is in turn supported on a retraction plate, which in turn is supported on the slide shoes of the pistons.

Provision may be made for the reference cylinder to intersect the circular cylindrical section of the cylinder, wherein the mouth openings are arranged entirely within, or are intersected by, the reference cylinder. The circular cylindrical sections of the cylinders are preferably arranged radially further to the outside than the respective mouth openings.

Provision may be made for the mouth openings to each be defined by a mouth channel with a constant cross-sectional shape, wherein the mouth channels are arranged so as to be inclined with respect to the axis of rotation such that they open out in each case in a corner region of the associated circular cylindrical section, in which the circular cylindrical section transitions into a base of the cylinder. The mouth channels accordingly have a small inclination relative to the axis of rotation. The change in direction of the fluid flow in the region of the mouth openings is consequently small, whereby the cavitation tendency is reduced.

Provision may be made for the second rotary bearing to comprise an inner ring, an outer ring and multiple rolling bodies, wherein all of the parts are carbonitrided. The first and the second rotary bearing are arranged far apart from one another in relation to a conventional axial piston machine. At the same time, the diameter of the drive shaft is relatively thin, because the first sections are arranged very far to the inside. This results in a relatively high degree of bending of the drive shaft. This has the effect, in particular, that the first rotary bearing, which is preferably designed as a tapered-roller bearing, is subjected to high load. By means of the proposed carbonitriding, the second rotary bearing nevertheless achieves the desired service life.

Provision may be made for the housing to comprise a first and a second housing part, wherein the first housing part is of pot-shaped form, wherein the first housing part defines an opening, wherein the opening is completely covered by the second housing part, wherein the at least one working channel is, outside the distributor plate, delimited entirely by the second housing part, wherein the first rotary bearing is accommodated in the second housing part. The second rotary bearing is preferably accommodated in the first housing part. The first and the second housing part may be sealed off against one another by means of a sealing ring or by means of a flat seal.

Provision may be made for the cylinder drum to have a rotational drive connection to the drive shaft by means of a spline toothing, wherein a circular cylindrical inner circumferential surface of the distributor plate is arranged approximately in alignment with a root circle diameter of the spline toothing of the drive shaft. The diameter of the inner circumferential surface is preferably between 95% and 110% of the root circle diameter of the spline toothing of the drive shaft.

It is self-evident that the features mentioned above and the features yet to be discussed below may be used not only in the respectively specified combination but also in other combinations or individually without departing from the scope of the disclosure.

BRIEF DESCRIPTION OF THE DRAWINGS

The disclosure will be discussed in more detail below on the basis of the appended drawings, in which.

DETAILED DESCRIPTION

Figure 1:
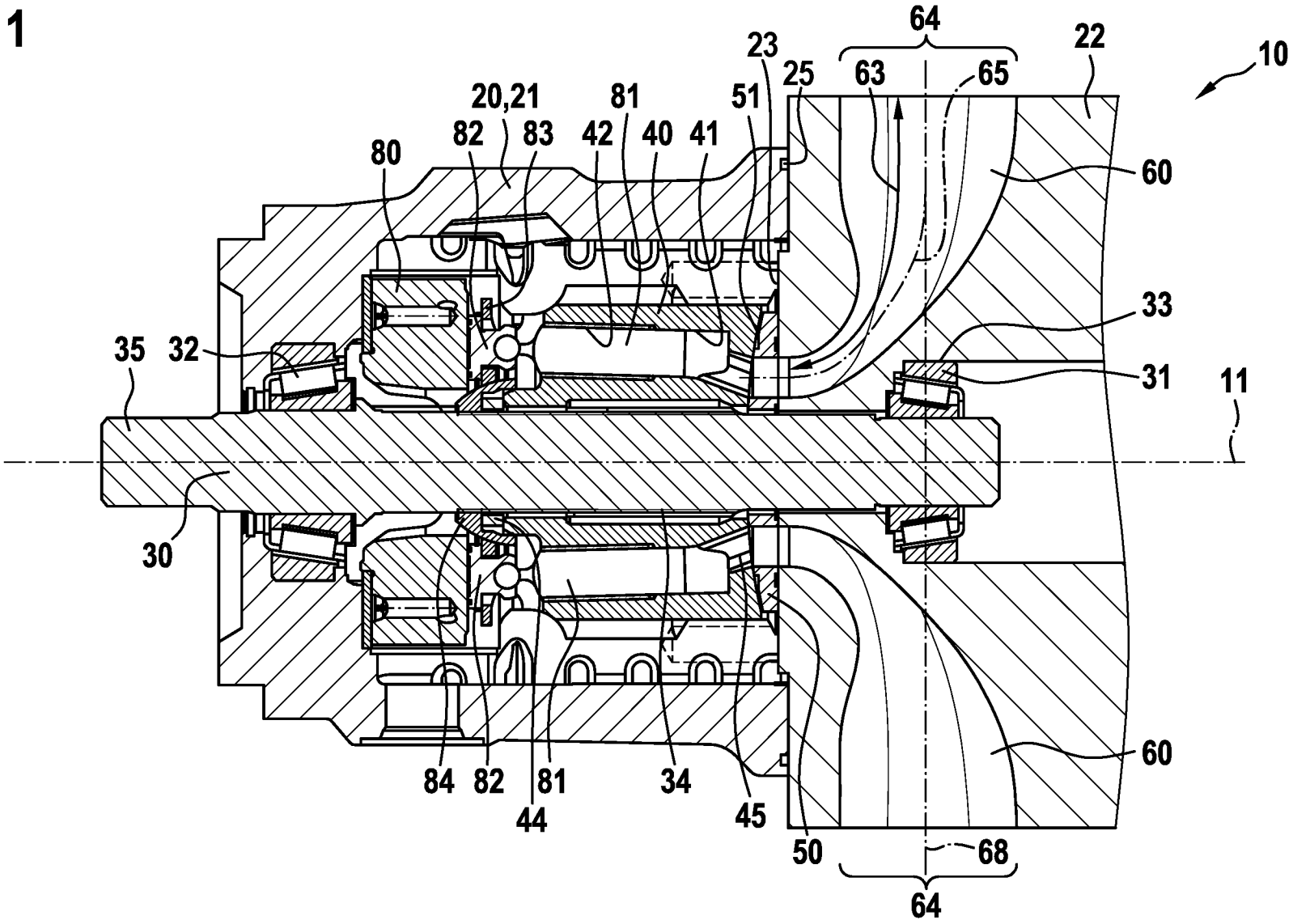
FIG. 1 shows a longitudinal section through an axial piston machine according to the disclosure.

FIG. 1 shows a longitudinal section through an axial piston machine 10 according to the disclosure. The axial piston machine 10 comprises a housing 20 which is made up of a first and a separate second housing part 21; 22. The first housing part 21 is of pot-shaped form, such that it has an opening, which points to the right in FIG. 1. The opening is completely covered by the second housing part 22. The first and the second housing part 21; 22 lie against one another at a planar sealing surface, wherein a seal 25 is arranged there, which seal closes off the housing 20 in fluid-tight fashion. The seal 25 may be designed as an O-ring or as a flat seal.

A second rotary bearing 32 is accommodated on the base of the first housing part 21, wherein a first rotary bearing 31 is accommodated in the second housing part 22. The first and the second rotary bearing 31; 32 are designed in the present case as tapered-roller bearings, which are installed in an X arrangement. The rotary bearings support a drive shaft 30, rotatably about an axis of rotation 11, on the housing 20. The drive shaft 30 is surrounded by a separate cylinder drum 40, wherein the drive shaft 30 and the cylinder drum 40 have a rotational drive connection by means of a spline toothing 34. Here, the spline toothing 34 on the cylinder drum 40 is shorter than the spline toothing 34 on the drive shaft 30. No spring is arranged between the cylinder drum 40 and the drive shaft 30, in order that the mouth openings (number 43 in FIG. 2) can be arranged as far to the inside as possible so as to allow high drive rotational speeds. The spring 44 is instead arranged at an end side on the cylinder drum 42, wherein the spring is supported on a separate pressure-exerting part 84. The pressure-exerting part 84 likewise engages into the spline toothing of the drive shaft 30 so as to rotate conjointly with the latter. The pressure-exerting part has a spherical surface, against which a separate retraction plate 83 is supported in the direction of the axis of rotation 11. The retraction plate 83 is therefore pivotable relative to the drive shaft 30, wherein the retraction plate follows the pivoting movement of the pivot cradle 80.

In the present case, the drive shaft 30 projects with a drive journal 35 out of the housing 20 at the first housing part 21. Drive journals or similar drive means may however also be provided at both sides of the housing 20 or only at the opposite side of the housing 20.

Multiple, for example seven or nine, cylinders 41 are arranged in the cylinder drum 40 so as to be distributed uniformly about the axis of rotation 11. The cylinders 41 have a circular cylindrical section 42, which in the present case is formed by a separate slide bushing that is fixedly installed in the cylinder drum 40. The circular cylindrical section 42 may however also be formed directly by the cylinder drum 40. In each case one associated piston 81 is received in linearly movable fashion in the circular cylindrical section 42, so as to form a cylinder chamber with variable volume. Each cylinder chamber has a mouth opening (number 43 in FIG. 2) via which the cylinder chamber has a fluid-exchanging connection to in each case one of the two working channels 60 in a manner dependent on the rotational position of the cylinder drum 40. In the context of the disclosure, the mouth openings (number 43 in FIG. 2) should be arranged as close as possible to the axis of rotation 11 in order that only relatively low centrifugal forces act on the pressure fluid there. The cylinder drum 40 can consequently rotate at a high rotational speed without cavitation occurring at the suction side. The pressure fluid is preferably a liquid, and most preferably hydraulic oil.

That end of each piston 81 which projects out of the cylinder drum 40 is connected by means of a ball joint to a separate slide shoe 82, which is supported on a planar control surface of the pivot cradle 80. In the unpressurized state in particular, the slide shoes 82 are pushed against the pivot cradle 80 by the spring 40 via the retraction plate 83. The corresponding opposing force pushes the cylinder drum 40 against the distributor plate 50, and this in turn against the second housing part 22. In the context of the disclosure, this force is relatively low, in particular in relation to axial piston machines that have a further spring between the cylinder drum 40 and the drive shaft 30. The pivot cradle 80 is pivotable about a pivot axis that is arranged perpendicular to the axis of rotation 11. In the present case, the pivot axis intersects the axis of rotation 11, wherein the pivot axis may also be arranged so as to be offset somewhat with respect to the axis of rotation 11. The pivot cradle 80 can be adjusted for example by means of a pivot cylinder (not illustrated) in order to adjust the displacement volume of the axial piston machine 10.

A separate distributor plate 50 is arranged between the cylinder drum 40 and the second housing part 22. In the case of conventional axial piston machines, the distributor plate is held transversely with respect to the axis of rotation 11 by the outer ring of the first rotary bearing 31. In the context of the disclosure, the first rotary bearing 31 is arranged with a spacing to the distributor plate 50 in the direction of the axis of rotation 11, such that the two working channels 60 can in this region be brought very close to the axis of rotation 11.

The second housing part 22 has a substantially planar support surface 23 through which the two working channels 60 extend, wherein the support surface is oriented perpendicular to the axis of rotation 11. The support surface 23 is provided with a retaining projection (number 24 in FIG. 2) of circular cylindrical form about the axis of rotation 11, which retaining projection holds the distributor plate 50 on the housing transversely with respect to the axis of rotation 11. Furthermore, the distributor plate 50 is secured against rotation relative to the housing 20, for example by means of a cylindrical pin (not illustrated). The distributor plate 50 is thus positionally fixed relative to the housing 20.

A relative movement between the cylinder drum 40 and the distributor plate 50 occurs at the sliding surface 51 of the distributor plate 50. The sliding surface 51 is rotationally symmetrical with respect to the axis of rotation 11 so as to allow a rotation of the cylinder drum 40. The sliding surface is furthermore concavely curved so as to hold the cylinder drum 40 transversely with respect to the axis of rotation 11. A planar sliding surface is likewise conceivable. In the present case, the rotational support of the cylinder drum 40 in the axial and radial directions is realized exclusively by way of the sliding surface 51. The first and the second rotary bearing 31; 32 alone support the drive shaft 30. The spline toothing 34 is designed such that substantially only a torque about the axis of rotation 11 can be transmitted.

As already discussed, the mouth openings (number 43 in FIG. 2) of the cylinders 41 should be brought as close as possible to the axis of rotation 11 in order that the cylinder drum 40 can be operated with a high rotational speed. This basic principle is known from DE 10 2015 208 925 A1. In the context of the disclosure, it is the intention for the working channels 60 to be improved such that the rotational speed of the cylinder drum 40 can be increased yet further without the suction separation discussed above occurring at the suction side, and with no cavitation occurring in the region of the mouth openings (number 43 in FIG. 2).

Figure 2:
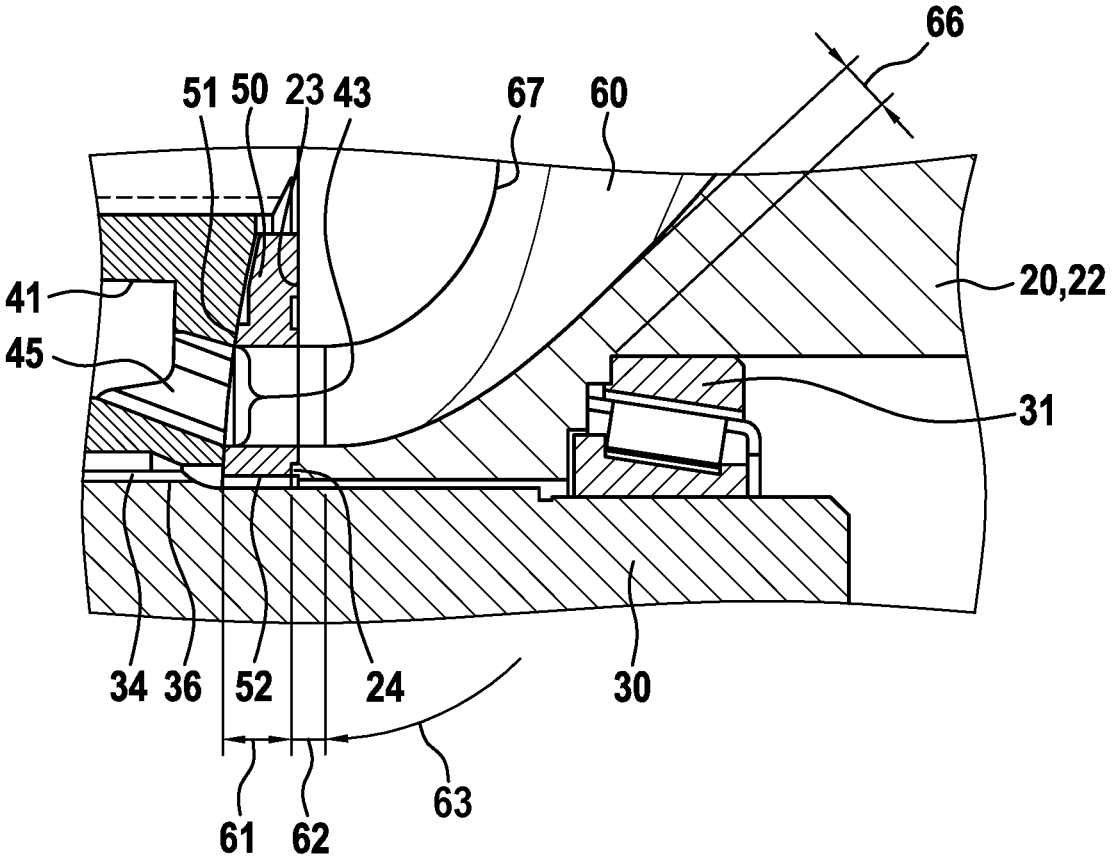
FIG. 2 shows an enlarged detail of FIG. 1 in the region of the distributor plate.

The inventors have recognized that, for this purpose, it is advantageous if the fluid flow is diverted as little as possible in the region of the mouth openings (number 43 in FIG. 2). The mouth channels 45 that define the mouth openings (number 43 in FIG. 2) are therefore arranged with a shallow inclination with respect to the axis of rotation 11. The mouth channels therefore open out in a corner region of the respective cylinder 41, in which the circular cylindrical section 42 transitions into a base of the cylinder 41. In the case of a conventional axial piston machine, the mouth channel opens out entirely at the base of the cylinder.

The two working channels 60 are mirror-symmetrical with respect to a plane of symmetry that encompasses the axis of rotation 11. The working channels have in each case one first, one second and one third section (numbers 61; 62; 63 in FIG. 2). The first section (number 61 in FIG. 2) runs entirely in the distributor plate 50. In the present case, the distributor plate has a single aperture for each working channel 50, which aperture runs with a constant cross-sectional shape parallel to the axis of rotation 11. The aperture is of kidney-shaped form. It can also be stated that the aperture is designed in the form of a slot that runs with a circular curvature about the axis of rotation 11. The two apertures are of identical design, because it is the intention for the present axial piston machine to be capable of 4-quadrant operation. That is to say, it is the intention for the direction of rotation of the drive shaft 30 to be reversible, wherein it is furthermore the intention for both working ports 64 to be operable selectively as a suction port or as a pressure port.

The second section (number 62 in FIG. 2) directly adjoins the first section (number 61 in FIG. 2), wherein the second section runs in the housing 20, specifically in the second housing part 22. The second section (number 62 in FIG. 2) likewise runs parallel to the axis of rotation 11. The second section has a constant cross-sectional shape which forms an aligned continuation of the cross-sectional shape of the first section (number 61 in FIG. 2). At the transition between the first and the second section (numbers 61; 62 in FIG. 2), there is accordingly no step and no bend that could influence the fluid flow. The first and the second section (numbers 61; 62 in FIG. 2), considered together, are of such a length that a substantially turbulence-free flow running parallel to the axis of rotation 11 can form, specifically in particular at the suction side. This flow is subjected to only a minimal diversion at the mouth opening (number 43 in FIG. 2). This disruption of the fluid flow is small in relation to the disruption caused by the rotating cylinder drum 40. Accordingly, despite the centrifugal forces acting in the mouth channel 45, the occurrence of cavitation is substantially avoided, even if the cylinder drum 40 is rotating at very high speed.

The third section 63 of the working channel 60 directly adjoins the second section (number 62 in FIG. 2), wherein the third section runs in the housing 20. The third section opens out at the outer side of the housing 20 at a circular working port 64. The third section 63 firstly has the task of changing the circular shape of the working port into the kidney shape of the respective mouth opening (number 43 in FIG. 2) without turbulence being generated in the fluid flow. Furthermore, the working channel 60 must be led past the first rotary bearing 31. The inherently optimum arrangement of the working ports in terms of flow, in the direction of the axis of rotation 11 and in alignment with the mouth openings (number 43 in FIG. 2), is obstructed by the first rotary bearing 31. Instead, the working ports 64 are arranged on opposite sides of the housing 20, in particular of the second housing part 22. The centers of area of the two working ports 64, specifically the corresponding circle central points, define a straight reference line 68 that intersects the first rotary bearing 31. The resulting curvature of the third section 63 yields particularly favorable flow conditions. Firstly, the cross-sectional central point 65 of the working channel 64 runs along a path with a uniform and smooth curvature. There are preferably no steps in the profile of the radius of curvature. Furthermore, there is a resulting characteristic profile of the inner delimiting surface 67 of the third section 63. Proceeding from the working port 64, the inner delimiting surface is initially concavely curved, and is convexly curved in the further profile towards the mouth opening. Specifically this profile contributes significantly to the formation of a substantially turbulence-free fluid flow, running parallel to the axis of rotation, in the first and in the second section (numbers 61; 62 in FIG. 2). It would basically be conceivable for the working ports 64 to be relocated to the right in FIG. 1, wherein the curvature reversal discussed above would be omitted. Tests carried out by the applicant have however shown that an axial piston machine of such design allows only lower rotational speeds than the axial piston machine 10 shown in FIG. 1.

FIG. 2 shows an enlarged detail of FIG. 1 in the region of the distributor plate 50. Here, it is firstly possible to see the retaining projection 24 on the support surface 23, by means of which retaining projection the distributor plate 50 is held transversely with respect to the axis of rotation. It is also possible to see the profile of the first and of the second section 61; 62 of the working channel 60 parallel to the axis of rotation. Also shown in FIG. 2 is the smallest spacing 66 between the working channel 60 and the first rotary bearing 31, the smallest spacing being arranged in the third section 63.

In FIG. 2, it is also possible to see the root circle diameter 36 of the spline toothing 34 of the drive shaft 30. The root circle diameter is situated approximately in alignment with the inner circumferential surface 52 of the distributor plate 50. With this arrangement, mouth openings 43 can be brought very close to the axis of rotation, without the drive shaft being excessively weakened.

REFERENCE DESIGNATIONS

10 Axial piston machine
11 Axis of rotation
20 Housing
21 First housing part
22 Second housing part
23 Support surface
24 Retaining projection
25 Seal
32 Drive shaft
31 First rotary bearing
32 Second rotary bearing
33 Outer circumferential surface of the first rotary bearing
34 Spline toothing
35 Drive journal
36 Root circle diameter of the spline toothing
40 Cylinder drum
41 Cylinder
42 Circular cylindrical section
43 Mouth opening
44 Spring
45 Mouth channel
50 Distributor plate
51 Sliding surface
52 Inner circumferential surface
60 Working channel
61 First section of the working channel
62 Second section of the working channel
63 Third section of the working channel
64 Working port
65 Cross-sectional central point of the working channel
66 Smallest spacing between the working channel and the first rotary bearing
67 Inner delimiting surface of the third section
68 Straight reference line
80 Pivot cradle
81 Piston
82 Slide shoe
83 Retraction plate
84 Pressure-exerting part

What is claimed is:

1. A swashplate-type axial piston machine comprising:

a housing;

a drive shaft supported on the housing rotatably about an axis of rotation by a first rotary bearing and a second rotary bearing;

a cylinder drum accommodated in the housing, the cylinder drum surrounding the drive shaft, the cylinder drum including a rotational drive connection to the drive shaft, the cylinder drum arranged between the first rotary bearing and the second rotary bearing;

a distributor plate arranged in a direction of the axis of rotation between the cylinder drum and a support surface on the housing, the distributor plate being arranged adjacent to the support surface and lying with a non-planar sliding surface, which is rotationally symmetrical with respect to the axis of rotation, against the cylinder drum such that the cylinder drum is held transversely with respect to the axis of rotation by the distributor plate; and at least one working channel that extends through the distributor plate, wherein each channel of the at least one working channel opens out at an outside on the housing at an associated working port, wherein the at least one working channel comprises a first section and a second section, wherein the first section extends over an entirety of the distributor plate, wherein the second section is arranged entirely in the housing, wherein the second section directly adjoins the first section, wherein the first rotary bearing has an outer circumferential surface that defines a circular cylindrical reference cylinder about the axis of rotation, wherein the first rotary bearing is arranged with a spacing to the distributor plate in the direction of the axis of rotation, wherein the distributor plate is held on the support surface transversely with respect to the axis of rotation, wherein the first section and the second section of the at least one working channel run parallel to the axis of rotation, and wherein the first section and the second section are arranged entirely within or are intersected by an extension of the reference cylinder that extends parallel to the direction of the axis of rotation.

2. The axial piston machine according to claim 1, wherein:

the first section of the at least one working channel extends through the distributor plate with a constant cross-sectional shape, and the cross-sectional shape has at least one section that is configured as a slot which is curved about the axis of rotation.

3. The axial piston machine according to claim 1, wherein:

the second section is directly adjoined by a third section of the at least one working channel, the third section is arranged in the housing, the cross-sectional central point of the third section runs along a curve with an unchanging curvature direction, the corresponding curvature is selected such that the respective working channel runs, over an entire length of the respective working channel, with a spacing to the first rotary bearing, and the working channel has a smallest spacing to the first rotary bearing in the third section.

4. The axial piston machine according to claim 3, wherein a curvature direction of an inner delimiting surface of the third section reverses along a course from the respective working port toward the distributor plate.

5. The axial piston machine according to claim 1, wherein the at least one working channel includes exactly two working channels, the associated working ports of which point away from one another.

6. The axial piston machine according to claim 5, wherein:

the two working ports each have a center of area, the two centers of area define a straight reference line, and the straight reference line intersects the first rotary bearing.

7. The axial piston machine according to claim 5, wherein:

the two working channels are of mirror-symmetrical form with respect to one another, and a corresponding plane of symmetry encompasses the axis of rotation.

8. The axial piston machine according to claim 5, wherein:

the cylinder drum has multiple cylinders which are of identical form to one another and which are arranged in uniformly distributed fashion about the axis of rotation, each cylinder has a circular cylindrical section with a first cross-sectional area, each cylinder has, in a region of the sliding surface, a mouth opening with a second cross-sectional area, the second cross-sectional area is smaller than the first cross-sectional area, such that a resultant hydrostatic force forces the cylinder drum against the sliding surface during operation, the cylinder drum is otherwise forced against the sliding surface exclusively by a single spring, and the spring lies against an end side of the cylinder drum.

9. The axial piston machine according to claim 8, wherein:

the reference cylinder intersects the circular cylindrical section of the cylinder, and the mouth openings are arranged entirely within, or are intersected by, the reference cylinder.

10. The axial piston machine according to claim 8, wherein:

the mouth openings are each defined by a mouth channel with a constant cross-sectional shape, and the mouth channels are arranged so as to be inclined with respect to the axis of rotation such that they open out in each case in a corner region of the associated circular cylindrical section, in which the circular cylindrical section transitions into a base of the cylinder.

11. The axial piston machine according to claim 1, wherein:

the second rotary bearing comprises an inner ring, an outer ring, and multiple rolling bodies, and the inner ring, the outer ring, and the multiple rolling bodies are carbonitrided.

12. The axial piston machine according to claim 1, wherein:

the housing comprises a first housing part and a second housing part, the first housing part is of pot-shaped form, the first housing part defines an opening completely covered by the second housing part, the at least one working channel is, outside the distributor plate, delimited entirely by the second housing part, and the first rotary bearing is accommodated in the second housing part.

13. The axial piston machine according to claim 1, wherein:

the rotational drive connection between the cylinder drum and the drive shaft includes a spline toothing connection, and a circular cylindrical inner circumferential surface of the distributor plate is arranged approximately in alignment with a root circle diameter of the spline toothing of the drive shaft.

* * * * *